US012139836B2

(12) United States Patent
Hombroek et al.

(10) Patent No.: US 12,139,836 B2
(45) Date of Patent: Nov. 12, 2024

(54) LAUNDRY WASHING MACHINE WITH DYNAMIC RINSE SYSTEM

(71) Applicant: Midea Group Co., Ltd., Foshan (CN)

(72) Inventors: Phillip C. Hombroek, Louisville, KY (US); Alexi Blaise Poth, Louisville, KY (US)

(73) Assignee: Midea Group Co., Ltd., Guangdong (CN)

( * ) Notice: Subject to any disclaimer, the term of this patent is extended or adjusted under 35 U.S.C. 154(b) by 0 days.

(21) Appl. No.: 17/851,218

(22) Filed: Jun. 28, 2022

(65) Prior Publication Data

US 2023/0416966 A1 Dec. 28, 2023

(51) Int. Cl.

| | |
|---|---|
| ***D06F 34/22*** | (2020.01) |
| ***D06F 21/00*** | (2006.01) |
| ***D06F 33/38*** | (2020.01) |
| ***D06F 33/40*** | (2020.01) |
| ***D06F 33/42*** | (2020.01) |
| *D06F 103/22* | (2020.01) |

(52) U.S. Cl.

CPC ..... *D06F 34/22* (2020.02); *D06F 21/00* (2013.01); *D06F 33/38* (2020.02); *D06F 33/40* (2020.02); *D06F 33/42* (2020.02); *D06F 2103/22* (2020.02)

(58) Field of Classification Search

CPC ..... D06F 34/22; D06F 33/42; D06F 33/40; D06F 33/38; D06F 21/00; D06F 2103/22

USPC ..... 68/12.02

See application file for complete search history.

(56) References Cited

U.S. PATENT DOCUMENTS

| | | | |
|---|---|---|---|
| 4,257,708 | A | 3/1981 | Fukuda |
| 4,889,644 | A | 12/1989 | Amberg et al. |
| 4,986,093 | A | 1/1991 | Pastryk et al. |
| 4,987,627 | A | 1/1991 | Cur et al. |
| 5,031,427 | A | 7/1991 | Pastryk et al. |
| 5,161,393 | A | 11/1992 | Payne et al. |
| 5,167,722 | A | 12/1992 | Pastryk et al. |

(Continued)

FOREIGN PATENT DOCUMENTS

| | | | |
|---|---|---|---|
| CN | 1378005 | A | 11/2002 |
| CN | 1880543 | A | 12/2006 |

(Continued)

OTHER PUBLICATIONS

CN103334258A—Machine translation (Year: 2013).*

(Continued)

*Primary Examiner* — Tinsae B Ayalew

(74) *Attorney, Agent, or Firm* — Gray Ice Higdon

(57) ABSTRACT

A laundry washing machine and method utilize a fluid property sensor to sense a fluid property of a fluid during a wash cycle to sense the level of detergent remaining in a load and control a rinse operation performed thereafter based upon the sensed fluid property. In some instances, the fluid property may be sensed while the load is being spun at a rate sufficient to cause fluid to be released from the load such that the sensed fluid property is based at least in part on fluid that was previously absorbed into the load. In addition, in some instances, the fluid property may be sensed during a spin phase of a wash cycle to selectively cause a wash cycle to selectively revert to an additional rinse phase when required, or otherwise proceed directly to the remainder of the spin phase to complete the wash cycle.

17 Claims, 6 Drawing Sheets

(56) References Cited

U.S. PATENT DOCUMENTS

| | | | |
|---|---|---|---|
| 5,373,714 | A | 12/1994 | Wada |
| 5,555,583 | A | 9/1996 | Berkcan |
| 5,560,060 | A | 10/1996 | Dausch et al. |
| 5,589,935 | A | 12/1996 | Biard |
| 5,603,233 | A | 2/1997 | Erickson et al. |
| 5,611,867 | A | 3/1997 | Cooper et al. |
| 5,731,868 | A | 3/1998 | Okey et al. |
| 5,737,790 | A | 4/1998 | Badger et al. |
| 5,768,729 | A | 6/1998 | Cracraft |
| 5,897,672 | A | 4/1999 | Badami et al. |
| 6,023,950 | A | 2/2000 | Battistella |
| 6,536,243 | B2 | 3/2003 | Sasano |
| 6,842,929 | B2 | 1/2005 | Kim et al. |
| 7,062,810 | B2 | 6/2006 | Hardaway et al. |
| 7,380,303 | B2 | 6/2008 | Bellinetto et al. |
| 7,392,813 | B2 | 7/2008 | Bertram et al. |
| 7,421,752 | B2 | 9/2008 | Donadon et al. |
| 7,451,510 | B2 | 11/2008 | Lee |
| 7,958,584 | B2 | 6/2011 | Suel, II et al. |
| 8,505,139 | B2 | 8/2013 | Vanhazebrouck et al. |
| 8,627,524 | B2 | 1/2014 | Urbanet et al. |
| 8,719,985 | B2 | 5/2014 | Park et al. |
| 8,834,646 | B2 | 9/2014 | Bewley, Jr. |
| 8,910,335 | B2 | 12/2014 | Kim et al. |
| 9,139,946 | B2 | 9/2015 | Dogan et al. |
| 9,243,987 | B2 | 1/2016 | Chanda et al. |
| 9,534,338 | B2 | 1/2017 | Fagstad et al. |
| 10,161,074 | B2 | 12/2018 | Hombroek et al. |
| 10,161,075 | B2 | 12/2018 | Hombroek et al. |
| 10,273,622 | B2 | 4/2019 | Hombroek et al. |
| 10,358,760 | B2 | 7/2019 | Hombroek et al. |
| 10,400,378 | B2 | 9/2019 | Driussi |
| 10,612,175 | B2 | 4/2020 | Hombroek |
| 10,619,286 | B2 | 4/2020 | Pesavento et al. |
| 2001/0002542 | A1 | 6/2001 | Sasano |
| 2003/0196278 | A1 | 10/2003 | Durfee |
| 2004/0244433 | A1 | 12/2004 | Lee et al. |
| 2005/0022317 | A1 | 2/2005 | Shaffer |
| 2005/0166334 | A1 | 8/2005 | Clouser |
| 2007/0113595 | A1* | 5/2007 | Harwood ..... D06F 39/087 68/12.01 |
| 2008/0041115 | A1 | 2/2008 | Kanazawa et al. |
| 2008/0276964 | A1 | 11/2008 | Hendrickson et al. |
| 2010/0095465 | A1 | 4/2010 | Kim et al. |
| 2012/0060299 | A1 | 3/2012 | Kim et al. |
| 2012/0103026 | A1 | 5/2012 | Oyama et al. |
| 2012/0312055 | A1 | 12/2012 | Fagstad et al. |
| 2013/0125595 | A1 | 5/2013 | Seo et al. |
| 2013/0145563 | A1 | 6/2013 | Kang |
| 2013/0312202 | A1 | 11/2013 | Balinski et al. |
| 2014/0259441 | A1 | 1/2014 | Fulmer et al. |
| 2014/0123400 | A1 | 5/2014 | Gasparini et al. |
| 2014/0123403 | A1 | 5/2014 | Zattin et al. |
| 2014/0326067 | A1 | 11/2014 | Chanda et al. |
| 2015/0000047 | A1* | 1/2015 | Obregon ..... D06F 34/18 68/12.04 |
| 2018/0002858 | A1 | 1/2018 | Hombroek |
| 2018/0087198 | A1 | 3/2018 | Kim et al. |
| 2019/0264372 | A1 | 8/2019 | Kessler et al. |
| 2019/0352834 | A1 | 11/2019 | Clara et al. |
| 2020/0071871 | A1 | 3/2020 | Kim et al. |
| 2021/0381150 | A1 | 12/2021 | Hombroek et al. |
| 2023/0183903 | A1 | 6/2023 | Hombroek |
| 2023/0183904 | A1 | 6/2023 | Hombroek |

FOREIGN PATENT DOCUMENTS

| | | | |
|---|---|---|---|
| CN | 100532689 | C | 8/2009 |
| CN | 101935936 | A | 1/2011 |
| CN | 102199854 | A | 9/2011 |
| CN | 102199855 | A | 9/2011 |
| CN | 102260981 | A | 11/2011 |
| CN | 102465421 | A | 5/2012 |
| CN | 103306096 | A | 9/2013 |
| CN | 103334257 | | 10/2013 |
| CN | 103334258 | | 10/2013 |
| CN | 103485121 | A | 1/2014 |
| CN | 203514043 | | 4/2014 |
| CN | 103797175 | A | 5/2014 |
| CN | 103898711 | | 7/2014 |
| CN | 104233700 | A | 12/2014 |
| CN | 104790179 | A | 7/2015 |
| CN | 105063956 | | 11/2015 |
| CN | 109477272 | A | 3/2019 |
| CN | 109554889 | A | 4/2019 |
| CN | 110512394 | A | 11/2019 |
| DE | 2844755 | | 4/1980 |
| DE | 102008055643 | A1 | 5/2010 |
| DE | 102010029890 | A1 | 12/2011 |
| EP | 0178031 | | 4/1986 |
| EP | 0787848 | A1 | 8/1997 |
| EP | 0962576 | | 12/1999 |
| EP | 2518203 | | 10/2012 |
| EP | 2752514 | A1 | 7/2014 |
| GB | 2262363 | | 6/1993 |
| JP | 04054998 | A | 6/1990 |
| JP | H0332699 | A | 2/1991 |
| JP | H04122384 | A | 4/1992 |
| JP | H06218183 | A | 8/1994 |
| JP | H07171289 | A | 7/1995 |
| JP | H08141273 | A | 6/1996 |
| JP | 2011200526 | | 10/2011 |
| KR | 100971018 | B1 | 7/2010 |
| KR | 20140019551 | A | 2/2014 |
| WO | 2007003593 | | 1/2007 |
| WO | 2012089605 | A1 | 7/2012 |
| WO | 2014205861 | A1 | 1/2016 |
| WO | 2018001077 | A1 | 1/2018 |

OTHER PUBLICATIONS

Leveraging Lasers—Retrieved from: https://www.finisar.com/sites/default/files/resources/Appliance%20Design-VCSEL%20turbidity%20Sensor.pdf Dec. 21, 2015.

U.S. Patent Office; Office Action issued in U.S. Appl. No. 15/198,890 dated Feb. 9, 2018.

U.S. Patent Office; Notice of Allowance issued in U.S. Appl. No. 16/355,690 dated Nov. 30, 2021.

Transmittal of Related Applications.

U.S. Patent Office; Non-Final Office Action issued in U.S. Appl. No. 15/198,971 dated Apr. 2, 2018.

International Search Report and Written Opinion issued in Application No. PCT/CN2021/098144 dated Aug. 30, 2021.

U.S. Patent Office; Office Action issued in U.S. Appl. No. 15/198,883 dated Apr. 20, 2018.

U.S. Patent Office; Office Action issued in U.S. Appl. No. 15/198,865 dated Jun. 13, 2018.

International Search Report and Written Opinion issued in Application No. PCT/CN2017/087805 dated Sep. 20, 2017.

International Search Report and Written Opinion issued in Application No. PCT/CN2017/087804 dated Sep. 4, 2017.

International Search Report and Written Opinion issued in Application No. PCT/CN2017/087800 dated Jul. 27, 2017.

International Search Report and Written Opinion issued in Application No. PCT/CN2017/087799 dated Sep. 13, 2017.

U.S. Patent Office; Final Office Action issued in U.S. Appl. No. 15/198,971 dated Oct. 9, 2018.

U.S. Patent Office; Notice of Allowance issued in U.S. Appl. No. 15/198,890 dated Apr. 6, 2018.

U.S. Patent Office; Notice of Allowance issued in U.S. Appl. No. 15/198,883 dated Sep. 12, 2018.

U.S. Patent Office; Advisory Action issued in U.S. Appl. No. 15/198,971 dated Jan. 22, 2019.

U.S. Patent Office; Notice of Allowance issued in U.S. Appl. No. 15/198,865 dated Jan. 24, 2019.

U.S. Patent Office; Notice of Allowance issued in U.S. Appl. No. 15/198,971 dated Mar. 7, 2019.

U.S. Patent Office; Office Action issued in U.S. Appl. No. 16/229,521 dated May 26, 2020.

(56) References Cited

OTHER PUBLICATIONS

U.S. Patent Office; Notice of Allowance issued in U.S. Appl. No. 16/229,521 dated Nov. 3, 2020.
U.S. Patent Office; Office Action issued in U.S. Appl. No. 16/355,690 dated Jun. 1, 2021.
Shahinian, Levon J., United States Patent and Trademark Office, Non-Final Office Action issued in U.S. Appl. No. 17/547,703, 40 pages, dated Jun. 21, 2024.
Shahinian, Levon J., United States Patent and Trademark Office, Non-Final Office Action issued in U.S. Appl. No. 17/825,662, 37 pages, dated Aug. 1, 2024.

* cited by examiner

LAUNDRY WASHING MACHINE WITH DYNAMIC RINSE SYSTEM

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for an automated manner of optimizing the performance of a laundry washing machine for different types of loads, as well as reducing the burden on users when interacting with a laundry washing machine.

One particular area in which laundry washing machine performance may be sub-optimal is rinsing a load after it has been washed with detergent. Too much rinsing can cause excessive water and energy consumption and additional cycle time, while too little rinsing can cause excess detergent remaining in the fabric, leading to possible skin irritation or heightened allergy symptoms. Therefore, a continuing need exists in the art for improved rinsing for different types of loads.

SUMMARY

The invention addresses these and other problems associated with the art by providing a laundry washing machine and method that utilize a fluid property sensor to sense a fluid property of a fluid during a wash cycle to sense the level of detergent remaining in a load and control a rinse operation performed thereafter based upon the sensed fluid property. In some instances, the fluid property may be sensed while the load is being spun at a rate sufficient to cause fluid to be released from the load such that the sensed fluid property is based at least in part on fluid that was previously absorbed into the load. In addition, in some instances, the fluid property may be sensed during a spin phase of a wash cycle to selectively revert to an additional rinse phase when required, or otherwise proceed directly to the remainder of the spin phase to complete the wash cycle.

Therefore, consistent with one aspect of the invention, a laundry washing machine may include a wash tub disposed within a housing, a wash basket disposed within the wash tub and rotatable about an axis of rotation, a drive system coupled to the wash basket to spin the wash basket about the axis of rotation, a fluid property sensor configured to sense a fluid property that varies with an amount of detergent in fluid from the wash tub, and a controller coupled to the drive system and the fluid property sensor. The controller may be configured to, during a wash cycle for a load disposed in the wash basket, control the drive system to spin the wash basket to cause fluid to be released from the load and into the wash tub, determine with the fluid property sensor a fluid property value associated with the fluid released from the load and into the wash tub, and to control a rinse operation performed thereafter during the wash cycle based at least in part upon the determined fluid property value.

Further, in some embodiments, the controller is configured to spin the wash basket to cause fluid to be released from the load and into the wash tub by spinning the wash basket in a fluid release speed range. In addition, in some embodiments, the fluid release speed range is between about 100 RPM and about 500 RPM. Further, in some embodiments, the fluid property sensor is a combined conductivity and temperature sensor positioned at a bottom of the wash tub proximate a midpoint between the axis of rotation and a side wall of the wash tub.

Moreover, in some embodiments, the fluid property value is a conductivity value. Further, in some embodiments, the controller is configured to determine the fluid property value during a spin phase of the wash cycle. In some embodiments, the controller is configured to determine the fluid property value while the drive system is spinning the wash basket. Moreover, in some embodiments, the controller is configured to determine a rinse profile using the determined fluid property value, and to control the rinse operation using the determined rinse profile.

Further, in some embodiments, the rinse profile includes a fill duration and a drain duration. In addition, in some embodiments, the controller is configured to determine the rinse profile by comparing the fluid property value against a plurality of threshold values and to select between a plurality of rinse profiles based upon the comparisons. Also, in some embodiments, the controller is further configured to determine whether to perform an extra rinse operation based upon a comparison of the fluid property value with an additional threshold value.

Moreover, in some embodiments, the fluid property value is a conductivity value, the controller is configured to determine a conductivity ratio value by taking a ratio of the conductivity value with a baseline conductivity value, and the controller is configured to compare the fluid property value against the plurality of threshold values by comparing the conductivity ratio value against the plurality of threshold values. In some embodiments, the controller is configured to determine the baseline conductivity value during an initial fill phase of the wash cycle. Further, in some embodiments, the baseline conductivity value is determined during one or more prior wash cycles, a calibration operation, an installation process, or a testing process.

Also, in some embodiments, the fluid property value is a second fluid property value and the rinse operation is an additional rinse operation, and the controller is further configured to, during a wash phase of the wash cycle and prior to determining the second fluid property value, determine with the fluid property sensor a first fluid property value, and to control a preliminary rinse operation performed prior to the additional rinse operation based at least in part upon the first fluid property value.

Further, in some embodiments, the controller is configured to determine the first fluid property value after agitating the load during the wash phase of the wash cycle. Also, in some embodiments, the controller is configured to determine whether to perform the rinse operation based at least in part upon the determined fluid property value. In addition, in some embodiments, the controller is configured to, after controlling the rinse operation, control the drive system to spin the wash basket to cause second fluid to be released from the load and into the wash tub and determine with the fluid property sensor a second fluid property value associated with the second fluid released from the load and into the wash tub, to determine that no additional rinse operation is needed based at least in part upon the determined second fluid property value, and to thereafter accelerate spinning of the load above that at which the load is spun when determining the second fluid property value.

Consistent with another aspect of the invention, a laundry washing machine may include a wash tub disposed within a housing, a wash basket disposed within the wash tub and rotatable about an axis of rotation, a drive system coupled to the wash basket to spin the wash basket about the axis of rotation, a fluid property sensor configured to sense a fluid property that varies with an amount of detergent in fluid from the wash tub, and a controller coupled to the drive system and the fluid property sensor. The controller may be configured to, during a spin phase of a wash cycle for a load disposed in the wash basket, determine with the fluid property sensor a fluid property value associated with fluid released from the load and into the wash tub during the spin phase, and to selectively revert to an additional rinse phase during the wash cycle based at least in part upon the determined fluid property value.

Moreover, in some embodiments, the controller is configured to control the drive system to spin the wash basket at a first speed to cause the fluid to be released from the load and determine the fluid property value while the load is being spun at the first speed, and the controller is configured to, in response to a determination to not selectively revert to the additional rinse phase, accelerate spinning of the load above the first speed to complete the spin phase.

Other embodiments may include various methods of operating a laundry washing machine utilizing the various operations described above.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
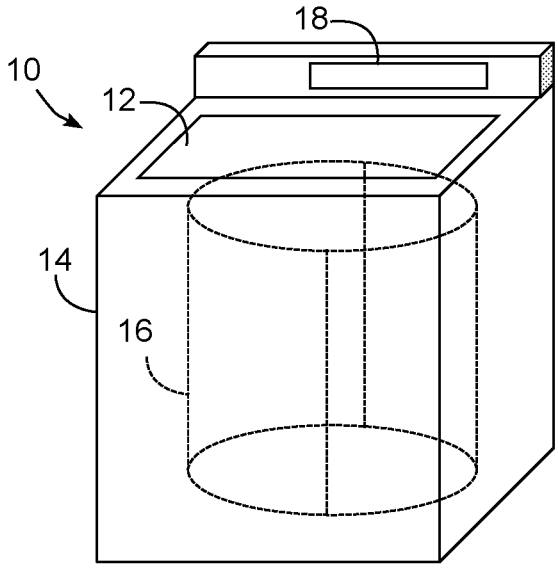
FIG. 1 is a perspective view of a top-load laundry washing machine consistent with some embodiments of the invention.

Embodiments consistent with the invention may incorporate a dynamic rinse system that controls a rinse operation performed by a laundry washing machine using a fluid property sensed by a fluid property sensor in a wash tub during a wash cycle. The fluid property may be representative of an amount of detergent in the fluid, e.g., conductivity and/or turbidity, and may be used to control, in some instances, whether a rinse operation is required, and in some instances, when a rinse operation is required, a rinse profile to be used for that rinse operation.

As will become more apparent below, in some instances the fluid property may be sensed when a load disposed in the wash tub is spun at a sufficient rate that causes fluid to be released from the load and into the wash tub, such that at least a portion of the fluid sensed by the fluid property sensor is fluid that has be released from the load, and thus is representative of the amount of detergent remaining in the load. In addition, as will also become more apparent below, in some instances the fluid property may be sensed during a portion of a spin phase, i.e., after wash and rinse phases have already been performed, such that that a determination may be made as to whether to interrupt the spin phase and revert to another rinse phase, or to simply continue with the current spin phase and complete the wash cycle.

In some instances, rinse decisions may also be made in part based upon a load type that has been selected by a user, or in some instances, dynamically determined during a wash cycle. In this regard, a load type may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. In the illustrated embodiment, load types are principally distinguished based upon different fabric types (e.g., natural, cotton, wool, silk, synthetic, polyester, permanent press, wrinkle resistant, blends, etc.), and optionally, based on different article types (e.g., garments, towels, bedding, delicates, etc.). It will be appreciated, however, that load types may be defined based upon additional or alternative categorizations, e.g., color (colors, darks, whites, etc.); durability (delicates, work clothes, etc.), soil level (lightly soiled, normally soiled, heavily soiled loads, etc.), among others. Load types may also represent categories of loads that are unnamed, and that simply represent a combination of characteristics for which certain combinations of operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, a duration of a drain operation, etc.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
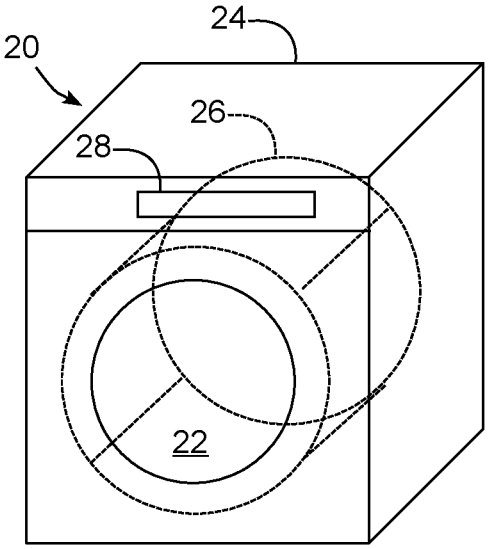
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
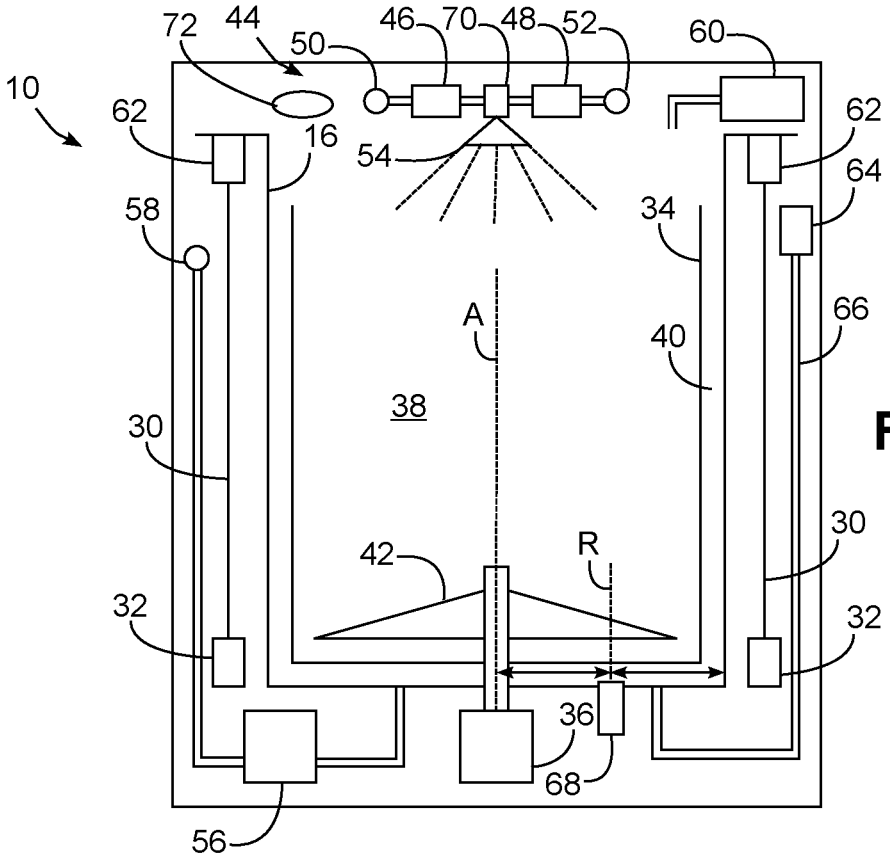
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump or drain system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, to support automated load type selection or otherwise to support automated selection of various operational settings, laundry washing machine 10 also includes a weight sensing system, and optionally various additional sensors such as a fluid level sensor, a fluid property sensor, a flow sensor, a color detection sensor, etc., as will be discussed in greater detail below. A weight sensing system may be used to sense the mass or weight of the contents of wash tub 16, e.g., when the wash tub is filled with water or even prior to filling the wash tub. In the illustrated embodiment, for example, a weight sensing system consistent with the invention may be implemented in laundry washing machine 10 at least in part using one or more weight sensors 62 that support wash tub 16 on one or more corresponding support rods 30. Each weight sensor 62 may be an electromechanical sensor that outputs a signal that varies with a displacement based on applied force (here, also representative of load or weight), and thus outputs a signal that varies with the weight of the contents of wash tub 16. Multiple weight sensors 62 may be used in some embodiments, and in some embodiments, the weight sensors may be implemented using load cells, while in other embodiments, other types of transducers or sensors that generate a signal that varies with applied force, e.g., strain gauges, may be used. Furthermore, while weight sensors 62 are illustrated as supporting wash tub 16 on support rods 30, the weight sensors may be positioned elsewhere in a laundry washing machine to generate one or more signals that vary in response to the weight of the contents of wash tub 16. In some embodiments, for example, transducers may be used to support an entire laundry washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensing system may also be used for vibration sensing purposes, e.g., to detect excessive vibrations resulting from an out-of-balance load. In other embodiments, however, no vibration sensing may be used, while in other embodiments, separate sensors may be used to sense vibrations. Further, in some embodiments, a single weight sensor employing a load cell or other transducer may be used (e.g., disposed proximate a corner of the housing), and the wash basket may be rotated when sensing the weight of the load such that a weight may be determined by averaging multiple force values captured during rotation of the wash basket.

A fluid level sensor may be used in some embodiments to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub. It will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, float sensors, laser sensors, etc.

Additional sensors may also be incorporated into laundry washing machine 10. For example, in some embodiments, a fluid property sensor 68 may be used to measure various properties of the fluid in the wash tub, e.g., conductivity and/or turbidity, e.g., to sense the presence or relative amount of various wash-related products such as detergents or fabric softeners and/or to sense the presence or relative amount of soil in the fluid. Further, in some embodiments, fluid property sensor 68 may also measure other characteristics of the fluid in wash tub 16, e.g., temperature. In other embodiments, separate sensors may be used to measure turbidity, conductivity and/or temperature, and further, other sensors may be incorporated to measure additional fluid characteristics. A fluid property sensor consistent with the invention may therefore be considered to include both a single sensor and a combination of sensors that are capable of sensing one or more fluid properties of a fluid.

In the illustrated embodiment, fluid property sensor 68 is a combined conductivity and temperature sensor that is capable of sensing both conductivity and temperature. Moreover, fluid property sensor 68 is desirably positioned at a bottom of the along a radius R relative to axis of rotation A that is substantially at a midpoint between axis of rotation A and the side wall of wash tub 16. It has been found, in particular, that such a position is suitable for sensing fluid properties of fluid while a load is being spun at a speed that is sufficient to cause fluid to release from the load, such that the fluid that is sensed is at least in part fluid that was previously held by the load and released as a result of being spun. By doing so, a fluid property such as conductivity may be used to sense a relative amount of detergent being released from the load while being spun, which in some embodiments is a property from which rinse decisions may be made.

It will be appreciated, however, that other fluid property sensor positions may be used in other embodiments. Moreover, where a front load washing machine is used, it may be desirable in some embodiments to position a fluid property sensor generally parallel to the direction of the spin and radially offset from the drain hole sump outer tangent point, e.g., about 0.5 to about 8 inches in some instances.

In addition, in some embodiments, a flow sensor 70 such as one or more flowmeters may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed. Therefore, in some embodiments, a timer may be used to determine the amount of water dispensed into wash tub 16.

In some instances, a color detection sensor 72 may be used to capture color composition data of one or more items of a load. In some embodiments, the color detection sensor 72 may be positioned to capture the color composition data as items are added to the wash tub 16. In some embodiments, the color detection sensor 72 may be an image sensor, or a camera.

Figure 4:
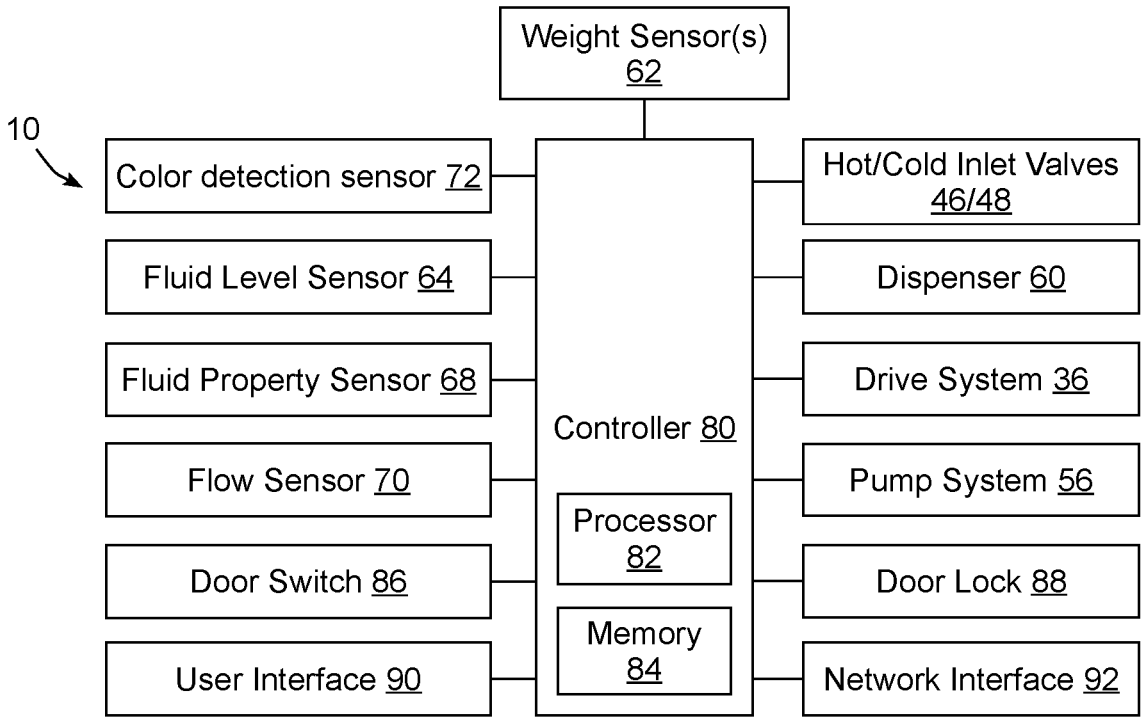
FIG. 4 is a block diagram of an example control system for the laundry washing machine of FIG. 1.

Now turning to FIG. 4, laundry washing machine 10 may be under the control of a controller 80 that receives inputs from a number of components and drives a number of components in response thereto. Controller 80 may, for example, include one or more processors 82 and a memory 84 within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80. Controller 80 may also be implemented as a microcontroller in some embodiments, and as such these terms are used interchangeably herein. Controller 80 may also include specialized circuit logic in some embodiments, which may be integrated into one or more integrated circuits in some embodiments, including into an integrated circuit that also incorporates one or more processors and/or memory (also referred to herein as a processor integrated circuit) and/or which may be separate from any integrated circuit (e.g., including logic circuitry on the same or a different module or circuit board).

As shown in FIG. 4, controller 80 may be interfaced with various components, including the aforementioned drive system 36, hot/cold inlet valves 46, 48, drain or pump system 56, dispenser 60, weight sensor(s) 62, fluid flow sensor 64, turbidity and/or conductivity sensor 68, flow sensor 70, and color detection sensor 72. In addition, controller 80 may be interfaced with additional components such as a door switch 86 that detects whether door 12 is in an open or closed position and a door lock 88 that selectively locks door 12 in a closed position. Moreover, controller 80 may be coupled to a user interface 90 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 92, e.g., for interfacing with external devices via wired and/or wireless networks such as Ethernet, Bluetooth, NFC, cellular and other suitable networks, including external devices such as end user computers, mobile phones, tablets, etc. and/or one or more cloud services. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Dynamic Rinse System

Embodiments consistent with the invention may incorporate a dynamic rinse system that controls a rinse operation performed by a laundry washing machine using a fluid property sensed by a fluid property sensor in a wash tub during a wash cycle. The fluid property may be representative of an amount of detergent in the fluid, and may be used to control, in some instances, whether a rinse operation is required, and in some instances, when a rinse operation is required, a rinse profile to be used for that rinse operation.

The discussion hereinafter will focus on the use of conductivity as the fluid property that is sensed, and thus the discussion below will focus predominantly on the use of a conductivity sensor to effectively determine an amount of detergent in fluid in a wash tub at various points in a wash cycle. However, it will be appreciated that in other embodiments, other fluid properties that vary at least in part based upon an amount of detergent in a fluid may be used, e.g., turbidity, or turbidity in combination with conductivity. Additional fluid properties, e.g., temperature, may also be sensed in some embodiments, as conductivity of aqueous fluids varies with temperature, so it may be desirable to compensate sensed conductivity for temperature and thereby normalize the sensed conductivity regardless of the temperature of the fluid being sensed.

As noted above, a rinse decision performed based upon sensed conductivity may, in some instances, determine a rinse profile for a rinse operation. A rinse profile, in this regard includes one or more operational settings that control how the rinse operation is performed. In some instances, for example, a rinse profile may define a rinse type for the rinse operation, e.g., a deep fill rinse where the load is rinsed by filling the wash tub with a quantity of fresh water, agitating the load with an agitator in the wash tub, and then draining the wash tub after some period of time, or a spray rinse where the load is rinsed by spraying the load with fresh water while spinning the wash basket, and generally while continuing to drain the wash tub. In some instances, the rinse profile may control both a fill duration and a drain duration, with the former defining the amount of time to open the inlet valve(s) to fill the wash tub, and the latter defining the amount of time to run the drain system. A rinse profile may also define other aspects of a rinse operation, e.g., fill temperature, fill quantity, agitation parameters, spin parameters, or practically any other parameter that controls how a rinse operation is performed.

Figure 5:
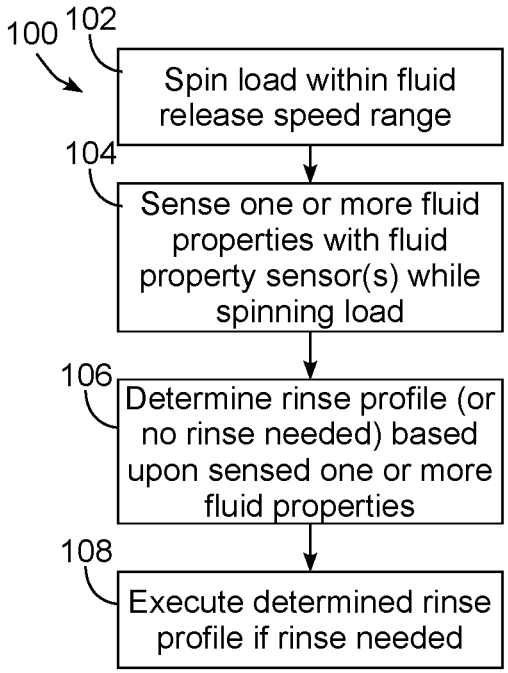
FIG. 5 is a flowchart illustrating an example sequence of operations for performing a rinse operation with the laundry washing machines of FIGS. 1-4.

Now turning to FIG. 5, in some instances conductivity and other fluid properties may be sensed specifically when a load disposed in the wash tub is spun at a sufficient rate that causes fluid to be released from the load and into the wash tub, such that at least a portion of the fluid sensed by the fluid property sensor is fluid that has be released from the load, and thus is representative of the amount of detergent remaining in the load. FIG. 5, in particular, illustrates a sequence of operations 100 for performing a rinse operation consistent with some embodiments of the invention. In block 102, the load is spun, e.g., using drive system 36 to rotate wash basket 34, within a fluid release speed range. In some embodiments, for example, the fluid release speed range is between about 100 RPM and about 500 RPM, and the speed is sufficient to cause at least a portion of the fluid absorbed into a load to be released by the load and into the wash tub, at which point it may be sensed by the fluid property sensor.

Next, in block 104, one or more fluid properties, e.g., conductivity and temperature, may be sensed by one or more fluid property sensors while the load is being spun in the fluid release speed range, and in block 106, a rinse profile may be determined based upon the sensed fluid properties. In some instances, the fluid properties may indicate that no further rinsing is needed, so rather than determining a rinse profile, a determination may be made that no rinse is needed at all. If a rinse is needed, block 108 then executes the determined rinse profile. If no rinse is needed, block 108 may be skipped.

Figure 6:
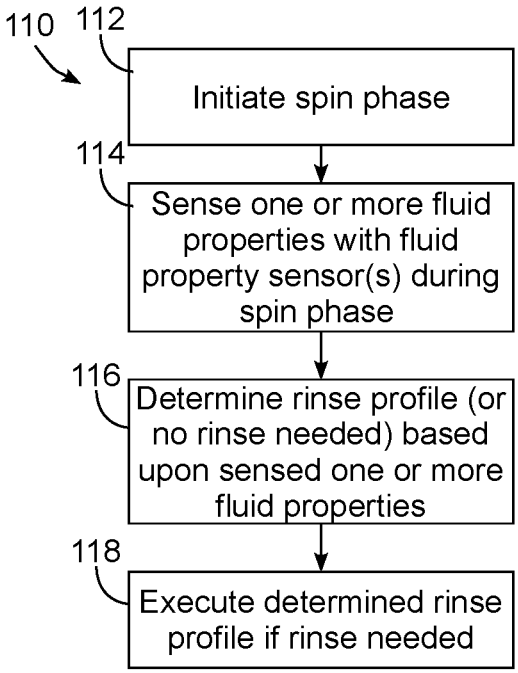
FIG. 6 is a flowchart illustrating another example sequence of operations for performing a rinse operation with the laundry washing machines of FIGS. 1-4.

Now turning to FIG. 6, in some instances conductivity and other fluid properties may be sensed during a portion of a spin phase, i.e., after wash and rinse phases have already been performed, such that that a determination may be made as to whether to interrupt the spin phase and revert to another rinse phase, or to simply continue with the current spin phase and complete the wash cycle. FIG. 6, in particular, illustrates a sequence of operations 110 for performing a rinse operation consistent with some embodiments of the invention. In block 112, a spin phase is initiated at the completion of a wash or rinse phase, and in block 114 one or more fluid properties, e.g., conductivity and temperature, may be sensed by one or more fluid property sensors. In block 116, a rinse profile may be determined based upon the sensed fluid properties. In some instances, the fluid properties may indicate that no further rinsing is needed, so rather than determining a rinse profile, a determination may be made that no rinse is needed at all. If a rinse is needed, block 118 then executes the determined rinse profile. If no rinse is needed, block 118 may be skipped.

It will be appreciated that in some embodiments, fluid properties may be sensed both while the wash cycle is in a spin phase and while the load is being spun; however, the invention is not specifically limited to such a combination. For example, fluid properties may be sensed in some embodiments while the load is being spun, but in different phases of a wash cycle. Moreover, fluid properties may be sensed in some embodiments during a spin phase but not while the load is being spun, e.g., a load may be spun to release water into the wash tub and sensing may be deferred until the load has come to a stop. Other variations will be apparent to those of those of ordinary skill having the benefit of the instant disclosure.

FIGS. 7-11 next illustrate various sequences of operations that may be used to perform a wash cycle in one of the laundry washing machines of FIGS. 1-4 to control one or more rinse operations in a wash cycle based at least in part on the conductivity of fluid in a wash tub at various points in the wash cycle.

Figure 7:
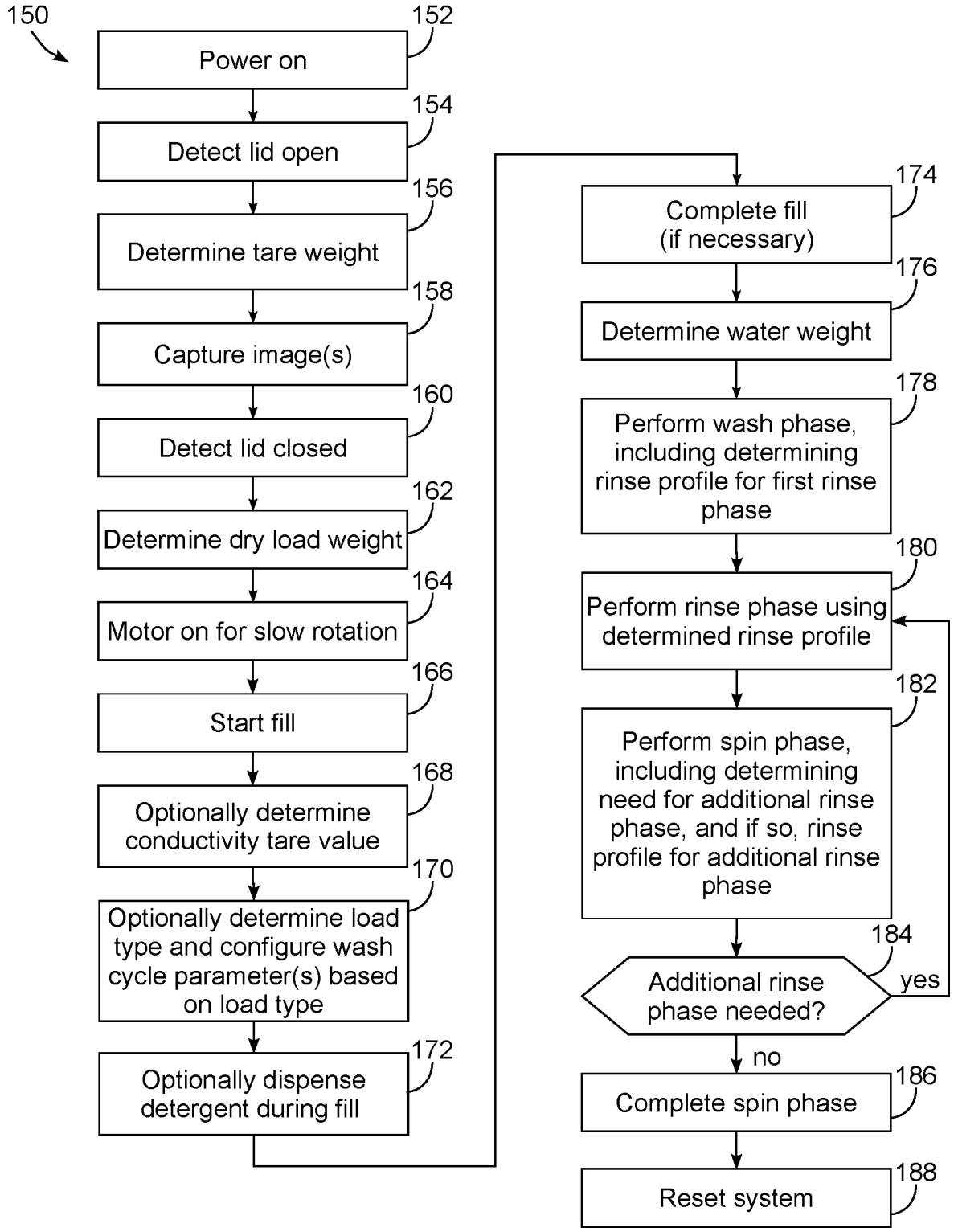
FIG. 7 is a flowchart illustrating an example sequence of operations for implementing a wash cycle in the laundry washing machines of FIGS. 1-4.

FIG. 7, for example, illustrates an example sequence of operations 150 for implementing a wash cycle in a laundry washing machine using a dynamic rinse system. A typical wash cycle includes multiple phases, including an initial fill phase where the wash tub is initially filled with water, a wash phase where a load that has been placed in the wash tub is washed by agitating the load with a wash liquor formed from the fill water and any wash products added manually or automatically by the washing machine, a rinse phase where the load is rinsed of detergent and/or other wash products (e.g., using a deep fill rinse where the wash tub is filled with fresh water and the load is agitated and/or a spray rinse where the load is sprayed with fresh water while spinning the load), and a spin phase where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different rinse operation types, different spin speeds, different water amounts, different wash product amounts, etc.

In this example sequence, a load type may be dynamically determined by a controller of the laundry washing machine, e.g., based on an automated load type selection algorithm, and in some instances based in part on analysis of various characteristics of a load placed in a wash tub by a user. Several suitable automated load type selection algorithms are described, for example, in U.S. Pat. Nos. 10,273,622 and 10,612,175, as well as U.S. PG Pub. No. 2021/0381150, filed on Jun. 4, 2020 by Hombroek et al., U.S. patent application Ser. No. 17/470,301, filed on Sep. 9, 2021 by Hooker et al., U.S. patent application Ser. No. 17/547,703, filed on Dec. 10, 2021 by Hombroek et al., and U.S. patent application Ser. No. 17/825,662, filed on May 26, 2022 by Hombroek et al. (all of which are assigned to Midea Group Co., Ltd. and are incorporated by reference herein), although it will be appreciated that other automated load type selection algorithms may be used in other embodiments. Moreover, in some embodiments, selection of a load type may be based on user input, e.g., user selection through a user interface of a particular type of load, based on a fabric and/or garment type selection, e.g., cottons, polyesters, towels, bedding, etc. In other embodiments, however, no load type selection may be performed, dynamic or otherwise, and a dynamic rinse system may be used independent of any load type selection.

In sequence 150, power on of the laundry washing machine may be performed in block 152, e.g., based upon user selection of a power button, and in block 154, an open lid may be detected. At this time, a tare weight, representative of the weight of an empty tub, may be determined in block 156. Next, in some embodiments, one or more images of the load may then be captured in block 158, with the image(s) used to determine a color composition of the load. Then, in block 160 closing of the lid may be detected. Next, a dry load weight may be determined (block 162), and then the motor that drives the wash basket may be turned on for slow rotation (block 164), e.g., at a speed of about 0 to about 100 RPM. In some embodiments, it may be desirable to determine the dry load weight while the wash basket is slowly rotating.

Next, an initial fill phase may be initiated in block 166. In addition, at this time it may be desirable to optionally determine a conductivity tare value in block 168, e.g. by sensing conductivity after a quantity of water has been added to the wash tub. As will become more apparent below, the conductivity tare value may effectively operate as a baseline conductivity representing a conductivity level that is desirably reached at the end of the wash cycle, and in some embodiments, a ratio may be taken between conductivity values sensed later in the wash cycle and this conductivity tare value to effectively measure the progress of rinsing, such that the rinse profiles of later rinse operations may be configured to efficiently rinse the load. As an alternative, a historical tare value may be used in lieu of a conductivity tare value sensed during the wash cycle. The historical tare value may be based on conductivity values collected during one or more prior wash cycles, based on one or more conductivity values collected during dedicated calibration operations performed during manufacture, or alternatively, as part of an installation process, or based on one or more conductivity values collected from multiple laundry wash machines as a result of a testing process.

In addition, in some embodiments it may be desirable to compare a conductivity tare value collected during a wash cycle against a threshold, and if that threshold is met, instead default to a historical tare value. For example, it will be appreciated that a conductivity tare value would desirably be collected when no detergent is in the wash tub, and prior to introduction of detergent into the wash tub, e.g., via a dispenser. On the other hand, if the load includes types and/or quantities of soil that could skew a conductivity reading, or if a user chooses to add detergent manually to the wash tub before starting the wash cycle, or has pretreated some articles of clothing such that residual cleaning products remain on the articles, it may be the case that the conductivity tare value collected during the wash cycle is not reflective of a fully rinsed load, such that if the conductivity tare value is too high, a default or historical tare value may be used in the alternative.

In addition, it may also be desirable in some embodiments to also collect temperature in block 168 and compensate the conductivity tare value for temperature. Other manners of determining a baseline tare value against which subsequent conductivity values are compared may be used in other embodiments, and in some embodiments, no baseline may be used or compared against when sensing conductivity.

Next, in block 170, a load type is optionally determined and one or more wash cycle parameters are accordingly set based on the determined load type. As discussed, for example, in a number of the aforementioned cross-referenced patents and applications, a load type may be determined in some instances based at least in part on multiple times determined based upon various fluid levels sensed by a fluid level sensor during and after the dispensation of water into the wash tub. In some embodiments, the automatic and dynamic selection may be performed in response to user selection of a particular mode (e.g., an "automatic" mode), while in other embodiments, automatic and dynamic selection may be used for all wash cycles. In still other embodiments, automatic and dynamic selection may further be based upon additional input provided by a user, e.g., soil level, article type, fabric type, article durability, etc. The dynamic selection may be based in part on judging the absorptivity of the fabric in the load against the weight of the load. A dry weight may be determined for the load in some embodiments at the beginning of a washing cycle (e.g., at the beginning of the fill phase) using a weight sensor and prior to dispensing any water into the wash tub. Thereafter, water may be dispensed into the wash tub (e.g., by spraying the load to saturate the fabrics in the load), and fluid levels sensed by a fluid level sensor while dispensing water into the wash tub as well as after water dispensing has been paused or stopped may be used to determine multiple times that may be compared against various load type criteria to select a load type from among a plurality of different load types. The load type may then be used, for example, to determine if and how much additional water should be added for the initial fill, as well as other operational settings for the wash cycle.

In some embodiments, a first time at which the fluid level reaches a predetermined fluid level while dispensing water into the wash tub and a peak time at which the fluid level stabilizes after the dispensing of water into the wash tub has been stopped or paused may be used to categorize a load into one of multiple load types, as both times are affected in part by the absorbency of the articles in a load. In some instances, the first time alone may be able to categorize some loads, as, for example, the first time may be relatively short for loads containing only low absorbency fabrics such as polyesters and other synthetic materials, or may be relatively long for loads containing highly absorbent articles or fabrics such as cotton articles, bedding or towels. By incorporating the peak time into the determination, however, it has been found that additional loads may be appropriately categorized, e.g., loads where absorbency is such that the first time alone is unable to suitably categorize the load. In addition, in some embodiments, the first time may be a sense time where water is first detected by a fluid level sensor, and an additional time, e.g., a fill time at which the fluid level reaches another predetermined fluid level such as a desired minimum fill level while dispensing water into the wash tub, may also be incorporated into the determination to categorize additional loads. The dry weight of the load may also factor into the dynamic detection of load type, e.g., by determining appropriate criteria against which the times are compared.

Returning to FIG. 7, in block 172 a detergent dispenser, if so provided, may optionally be activated to dispense detergent into the wash tub during the initial fill. Then, block 174 optionally dispenses an additional amount of water to complete the fill phase. For example, the additional amount of water may be selected to provide a total amount of dispensed water selected based upon load type or selected via a separate load size selection by the user. Thereafter, in block 176, a water weight may also be determined to determine the amount of water used during a cycle before the wash and rinse phases.

Next, in block 178, the wash cycle thereafter proceeds with one or more wash phases, and at this time, a first rinse decision is made in order to determine a rinse profile for the subsequent rinse phase. Block 180 uses the determined rinse profile to perform the rinse phase, and control then passes to block 182 to perform a spin phase. In addition, in the illustrated embodiment, during a portion of the spin phase a second rinse determination may be made to determine (a) whether an additional rinse is needed, and (b) if so, the rinse profile to sue for the additional rinse phase. Block 184 then determines whether the rinse decision determined that an additional rinse phase was needed, and if so, returns control to block 180 to perform that additional rinse phase using the appropriate rinse profile. Returning to block 184, if no additional rinse is determined to be needed, control passes to block 186 to complete the spin phase. The wash cycle is then complete, and the system is reset (block 188). It will be appreciated that load type may be used to control the spin phase according to a spin profile, and to control a drain operation performed during the spin phase, as discussed in the aforementioned U.S. patent application Ser. Nos. 17/547,703 and 17/825,662 cross-referenced above.

Figure 8:
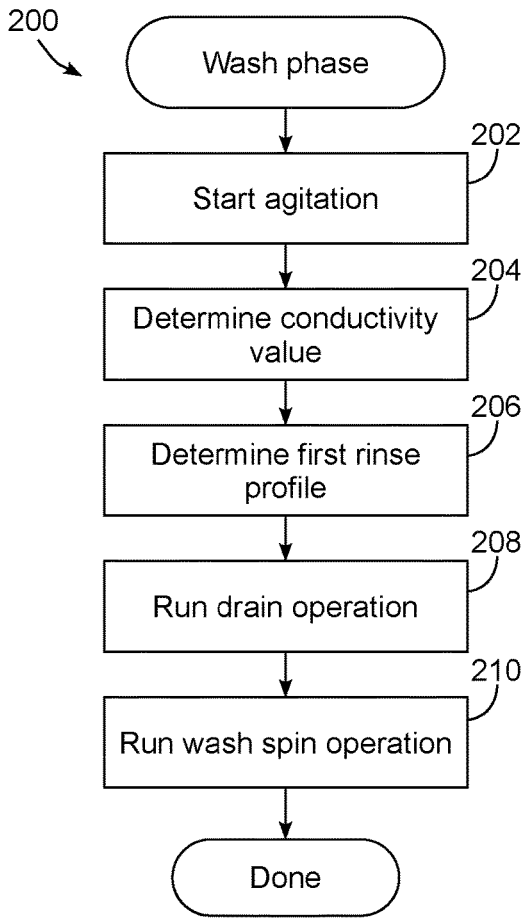
FIG. 8 is a flowchart illustrating an example sequence of operations for implementing the wash phase of the wash cycle of FIG. 7.

FIG. 8 illustrates a sequence of operations 200 for implementing the wash phase discussed above in connection with block 178 of FIG. 7. Sequence 200 is generally initiated once the initial fill is complete, and thus the wash tub is filled with fluid. In particular, in block 202, agitated is initiated, e.g., by setting the mode of the drive system to drive the agitator. Then, a first rinse decision is made during the wash phase by determining a conductivity value in block 204 (e.g., using fluid property sensor 68) and then determining a first rinse profile in block 206. It has been found that conductivity becomes stable after about one or two minutes of agitation, so in some embodiments it may be desirable to delay blocks 204 and 206 until after agitation is run for a predetermined duration (which may be shorter than, equal to, or longer than the amount of time that agitation is performed). In some embodiments, blocks 204 and 206 may be delayed until agitation is complete.

Thereafter, in block 208, a drain operation is run to drain fluid from the wash tub, and in block 210, a wash spin operation is performed, e.g., by setting the mode of the drive system to spin the wash basket. The wash phase is then complete. It will be appreciated that one or both of the drain and wash spin operations may be controlled based upon load type in some embodiments, e.g., as described in the aforementioned cross-referenced applications.

Figure 9:
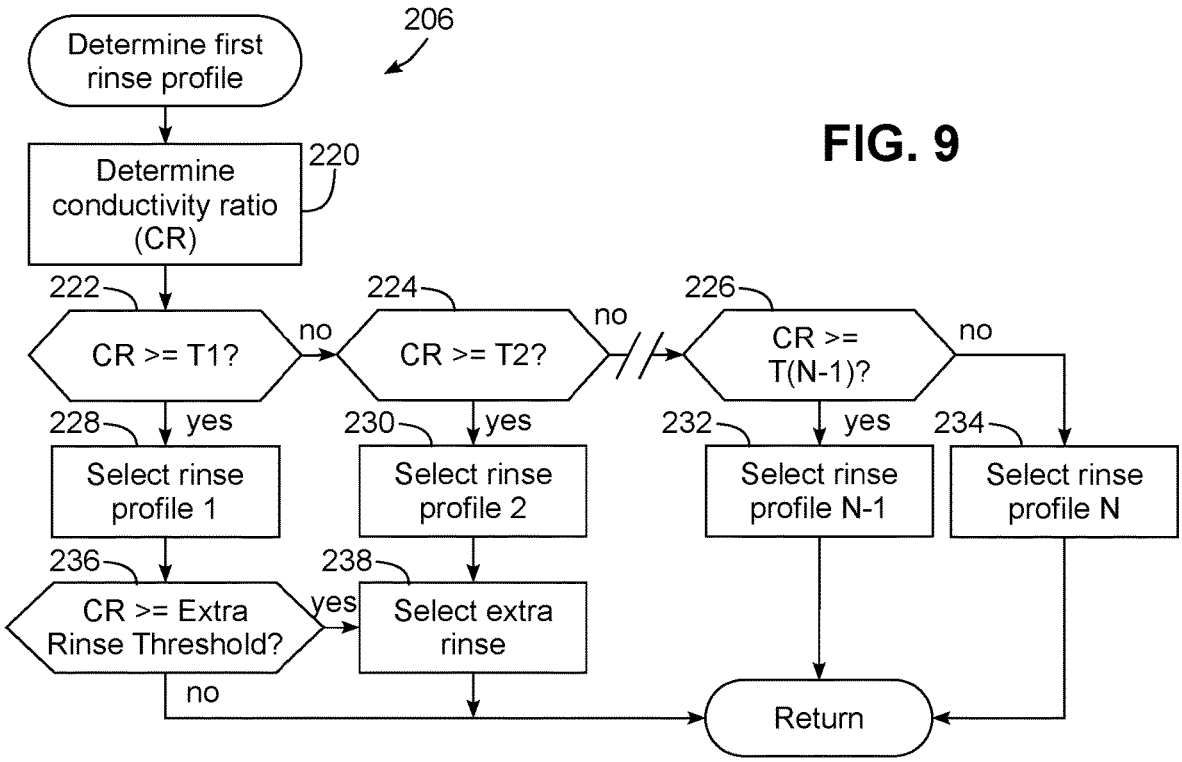
FIG. 9 is a flowchart illustrating an example sequence of operations for the determine first rinse profile block of FIG. 8.

FIG. 9 illustrates an example sequence of operations for implementing block 206 of FIG. 8 to make the first rinse decision, such that a suitable rinse profile is available when the first rinse operation is performed. In block 220, a conductivity ratio (CR) is calculated, e.g., by taking the ratio of the current conductivity value collected in block 204 of FIG. 8 and a baseline conductivity value, e.g., collected at the start of the wash cycle or based upon historical data as discussed above.

The conductivity ratio is then compared against one or more thresholds, e.g., thresholds T1, T2, . . . T(N−1), etc., as represented by blocks 222, 224 and 226, to select a rinse profile selected among N rinse profiles (rinse profiles 1 . . . N) established for the laundry washing machine, as represented by blocks 228, 230, 232 and 234. Each rinse profile may vary, for example, based upon various parameters such as rinse type (deep fill or spray), fill duration, drain duration, etc. In one example embodiment, each rinse profile may specify a fill duration, corresponding to an amount of time that one or both of the inlet valves are activated, and a drain duration, corresponding to an amount of time that the drain system is activated. Alternatively, a fill duration could be replaced with other representations of a fill amount, e.g., a pressure sensor reading, a volume sensed by a flow sensor, etc.

In addition, in some instances, it may be desirable to enable a rinse profile to be associated with an "extra rinse," i.e., an additional rinse operation performed after the initial rinse operation has been performed. As represented by rinse profile 1 that is detected in block 222 and selected in block 228, it may be desirable in some instances to make an extra rinse conditional on the conductivity ratio meeting a separate threshold (block 236), such that when the conductivity ratio is found to meet this threshold, control passes to block 238 to select the extra rinse. Alternatively, as represented by rinse profile 2 that is detected in block 224 and selected in block 230, an extra rinse may be not be conditioned on a separate threshold, but may instead be selected whenever rinse profile 2 has been selected by passing control directly to block 238.

In the illustrated embodiment, thresholds T1 . . . T(N−1) decrease in conductivity, such that rinse profiles 1 . . . N generally decrease in rinse intensity (e.g., duration, amount of water used, etc.) from rinse profile 1 (selected in block 228) to rinse profile N. Moreover, rinse profile N may be considered to be a "default" type of rinse profile, which is selected whenever the conductivity ratio does not match any of the thresholds. Alternatively, thresholds may be treated as upper limits, such that the thresholds increase in conductivity from threshold T1 to threshold T(N−1).

Figure 10:
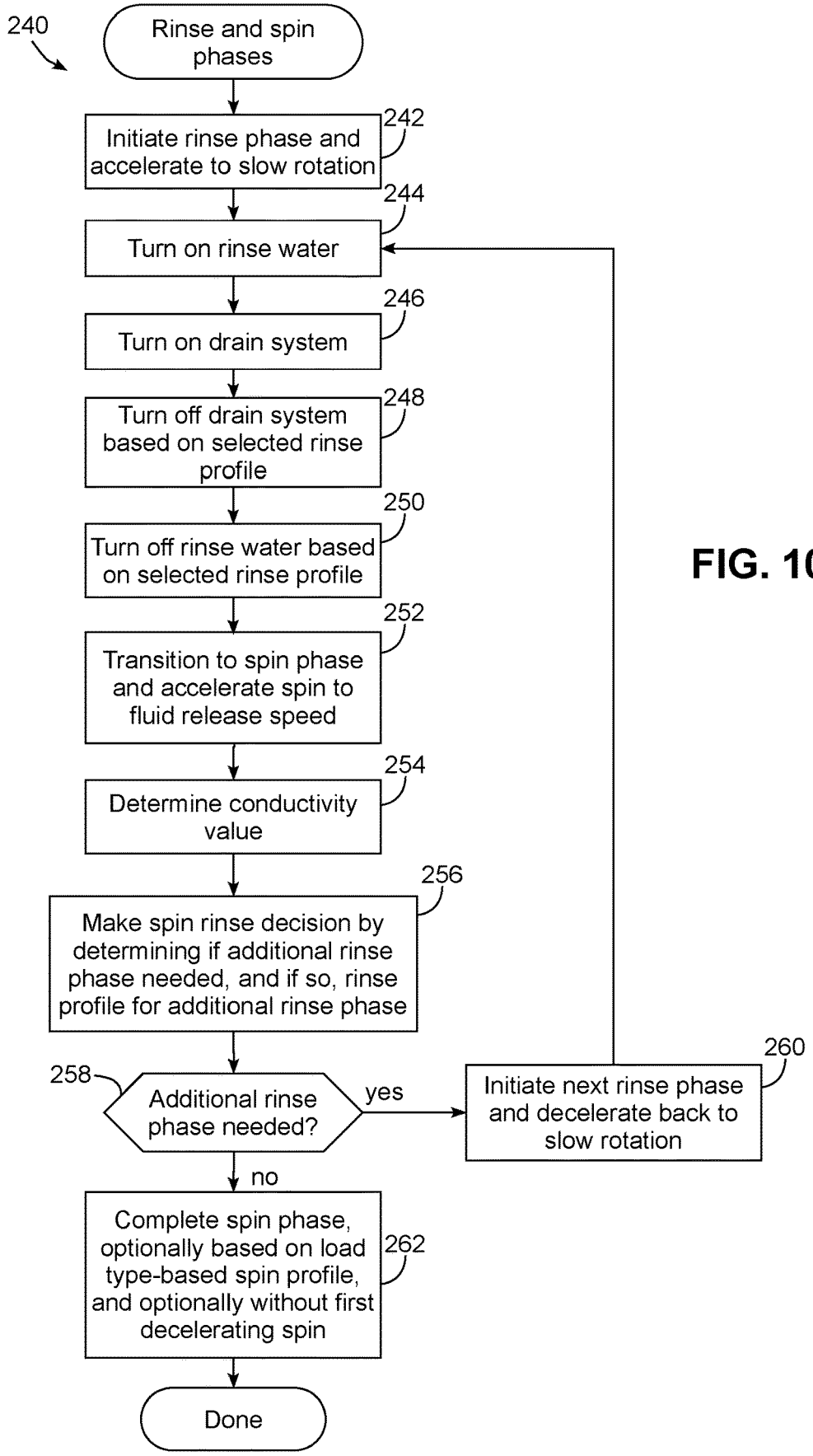
FIG. 10 is a flowchart illustrating an example sequence of operations for implementing the rinse and spin phases of the wash cycle of FIG. 7.

Now turning to FIG. 10, this figure illustrates an example sequence of operations 240 for implementing the rinse and spin phases of a wash cycle, e.g., corresponding to blocks 180-186 of FIG. 7. In block 242, the rinse phase is initiated and rotation of the wash basket is initiated to a relatively slow rotation speed (e.g., about 0 to about 100 RPM). One or both of the inlet valves are then opened in block 244 to turn on the rinse water to fill the wash tub, and in block 246 the drain system is turned on to open the drain. Based upon the selected rinse profile, the drain system is turned off, and the rinse water is turned off (blocks 248, 250) according to the fill and drain times specified by the selected rinse profile. It will be appreciated that the drain system may be turned off prior to or after the rinse water is turned off for different rinse profiles in various embodiments. In addition, it will be appreciated that in other embodiments, additional rinse-related activities, e.g., agitating during a deep fill rinse, may be used, and that different operations may be performed for different rinse types associated with different rinse profiles. In some embodiments, for example, during a non-deep fill rinse, the drain system may be turned on approximately half of the time that rinse water is being dispensed over the load.

Next, in block 252, a transition occurs to the spin phase and the wash basket is accelerated to a fluid release speed with the fluid release speed range to cause the load to release fluid into the bottom of the tub. At this point, a conductivity value may be collected by the fluid property sensor in block 254, such that the conductivity value is sensed both while the load is being spun at a fluid release speed and during the spin phase. Next, in block 256, a spin rinse decision is made to determine (a) whether an additional rinse phase is needed, and (b) if so, the rinse profile for that additional rinse phase. Block 258 determines whether the spin rinse decision has indicated that an additional rinse phase is needed, and if so, passes control to block 260 to initiate a next rinse phase and decelerate the wash basket back down to the slow rotation used in block 242. Control then returns to block 244 to perform the next rinse phase, using the newly selected rinse profile to control the performance of the next rinse phase.

Returning to block 258, if it is determined that no additional rinse phase is needed, control passes to block 262 to complete the spin phase, optionally based on a load type-based spin profile as discussed above, and optionally without decelerating the spinning of the wash basket. Thus, it will be appreciated that the load spin speed may in some embodiments accelerate from the fluid release speed at which it was rotated when the conductivity value was being collected directly into one or more spin segments, without having to slow down or stop, and thereby decreasing cycle time.

Figure 11:
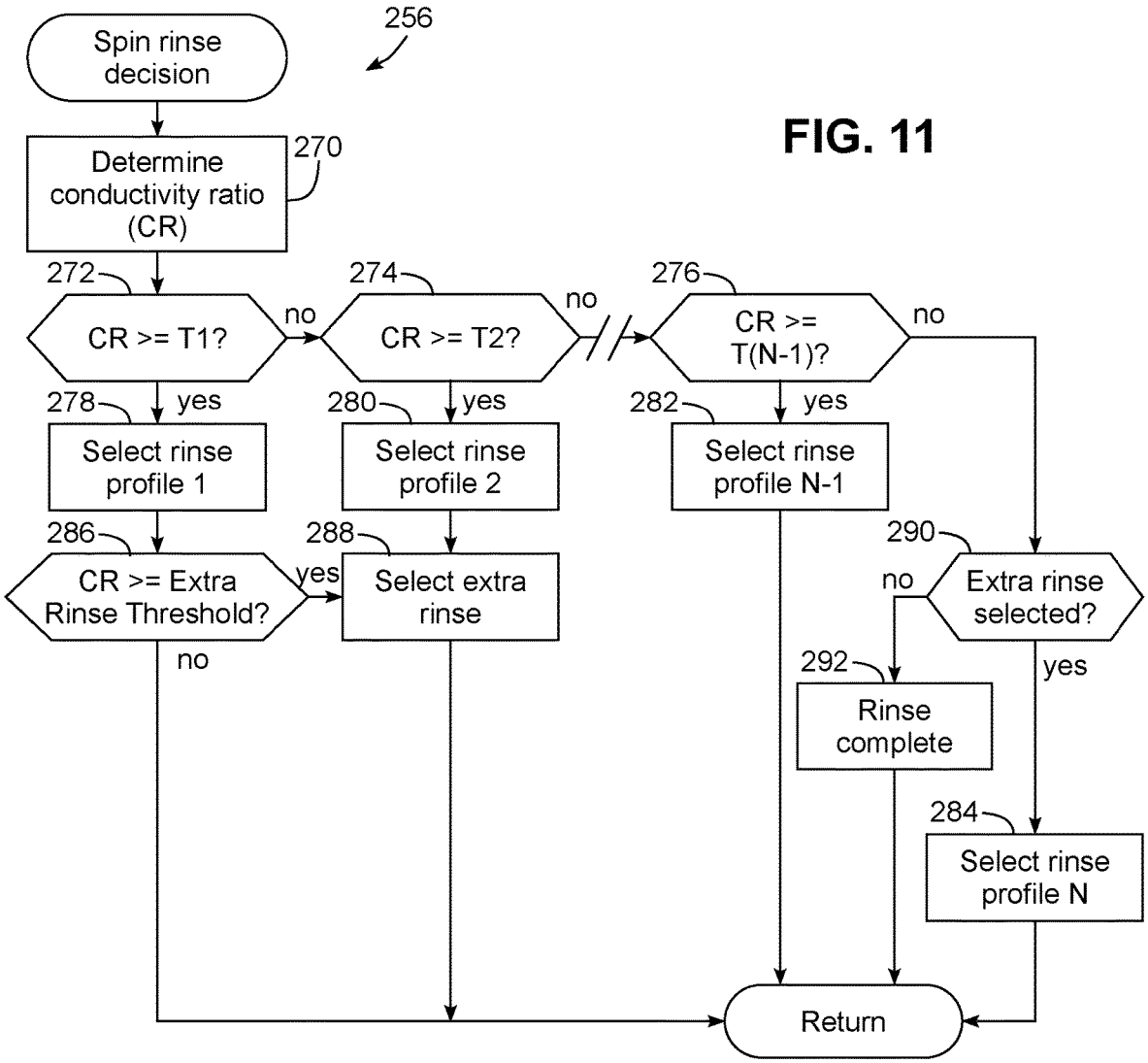
FIG. 11 is a flowchart illustrating an example sequence of operations for the spin rinse decision block of FIG. 10.

FIG. 11 illustrates an example sequence of operations for implementing block 256 of FIG. 10 to make a spin rinse decision, such that a determination may be made as to whether an additional rinse is needed, and if so, what the rinse profile should be for such additional rinse. In block 270, a conductivity ratio (CR) is calculated, e.g., by taking the ratio of the current conductivity value collected in block 254 of FIG. 10 and a baseline conductivity value, e.g., collected at the start of the wash cycle or based upon historical data as discussed above.

The conductivity ratio is then compared against one or more thresholds, e.g., thresholds T1, T2, . . . T(N−1), etc., as represented by blocks 272, 274 and 276, to select a rinse profile selected among N rinse profiles (rinse profiles 1 . . . N) established for the laundry washing machine, as represented by blocks 278, 280, 282 and 284. It will be appreciated that the same or different rinse profiles may be used for the initial rinse and any additional rinses, and that the same or different thresholds may be used (i.e., FIGS. 9 and 11 may, but not necessarily must, use the same thresholds and rinse profiles).

In addition, as with initial rinse operations, in some instances it may be desirable to enable a rinse profile to be associated with an additional extra rinse, i.e., potentially a third or greater rinse operation. As represented by rinse profile 1 that is detected in block 272 and selected in block 278, it may be desirable in some instances to make an extra rinse conditional on the conductivity ratio meeting a separate threshold (block 286), such that when the conductivity ratio is found to meet this threshold, control passes to block 288 to select the extra rinse. Alternatively, as represented by rinse profile 2 that is detected in block 274 and selected in block 280, an extra rinse may be not be conditioned on a separate threshold, but may instead be selected whenever rinse profile 2 has been selected by passing control directly to block 288.

Moreover, it will be appreciated that, as a result of the first rinse decision made in the sequence of FIG. 9, an additional extra rinse may have already been selected in block 238. As such, even in the event that the conductivity ratio does not meet the T(N−1) threshold in block 276, control passes to block 290 to determine if the extra rinse was previously selected. If so, control passes to block 284 to select the default rinse profile N, thus ensuring that the extra rinse specified in the prior rinse decision will still be performed. Otherwise, if no extra rinse was previously selected, block 276 passes control to block 292 to indicate that the rinse is complete, and no further rinsing is required.

Various manners of sensing conductivity or other fluid properties may be used in various embodiments. For example, where a combined conductivity and temperature sensor that reports sensed values by varying a duty cycle of a pulse width modulated output signal is used for the fluid property sensor, one manner of sensing conductivity and temperature may be to use a microcontroller input capture feature to capture rising and falling edge times of the sensor. An interrupt may be generated at each rising/falling edge, and interrupt service routines may be used to move the edge times from the capture registers to global variables and set a flag indicating that new times are available. Background functions may then check these flags to calculate new duty cycles. A separate function may be used to toggle a pin on the sensor to switch between conductivity sensing and temperature sensing on a periodic basis, and duty cycles may be converted to conductivity values and temperature values accordingly. It will be appreciated that with other types and/or combinations of sensors, other functions may be used in other embodiments.

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A laundry washing machine, comprising:

a wash tub disposed within a housing;

a wash basket disposed within the wash tub and rotatable about an axis of rotation;

a drive system coupled to the wash basket to spin the wash basket about the axis of rotation;

a fluid property sensor configured to sense a fluid property that varies with an amount of detergent in fluid from the wash tub; and a controller coupled to the drive system and the fluid property sensor, the controller configured to, during a wash cycle for a load disposed in the wash basket, control the drive system to spin the wash basket to cause fluid to be released from the load and into the wash tub, determine with the fluid property sensor a fluid property value associated with the fluid released from the load and into the wash tub while the drive system is spinning the wash basket, and to control a rinse operation performed thereafter during the wash cycle based at least in part upon the determined fluid property value;

wherein the controller is further configured to control the rinse operation by spinning the wash basket at a rate below 100 RPM, after controlling the rinse operation, control the drive system to spin the wash basket in a fluid release speed range between 100 RPM and 500 RPM to cause second fluid to be released from the load and into the wash tub and determine with the fluid property sensor a second fluid property value associated with the second fluid released from the load and into the wash tub, to determine that no additional rinse operation is needed based at least in part upon the determined second fluid property value, and to thereafter accelerate spinning of the load above the fluid release speed range at which the load is spun when determining the second fluid property value; and wherein the controller is configured to determine the second fluid property value while the wash basket is being spun in the fluid release speed range and while no rinse water is being supplied to the wash tub.

2. The laundry washing machine of claim 1, wherein the fluid property sensor is a combined conductivity and temperature sensor positioned at a bottom of the wash tub along a radius relative to the axis of rotation that is at a midpoint between the axis of rotation and a side wall of the wash tub.

3. The laundry washing machine of claim 1, wherein the fluid property value is a conductivity value.

4. The laundry washing machine of claim 1, wherein the controller is configured to determine the second fluid property value during a spin phase of the wash cycle.

5. The laundry washing machine of claim 1, wherein the controller is configured to determine a rinse profile using the determined fluid property value, and to control the rinse operation using the determined rinse profile.

6. The laundry washing machine of claim 5, wherein the rinse profile includes a fill duration and a drain duration.

7. The laundry washing machine of claim 5, wherein the controller is configured to determine the rinse profile by comparing the fluid property value against a plurality of threshold values and to select between three or more rinse profiles based upon the comparisons, wherein comparing the fluid property value and selecting between the three or more rinse profiles are performed prior to performing the rinse operation.

8. The laundry washing machine of claim 7, wherein the controller is further configured to determine whether to perform an extra rinse operation based upon a comparison of the fluid property value with an additional threshold value.

9. The laundry washing machine of claim 7, wherein the fluid property value is a conductivity value, the controller is configured to determine a conductivity ratio value by taking a ratio of the conductivity value with a baseline conductivity value, and the controller is configured to compare the fluid property value against the plurality of threshold values by comparing the conductivity ratio value against the plurality of threshold values.

10. The laundry washing machine of claim 9, wherein the controller is configured to determine the baseline conductivity value during an initial fill phase of the wash cycle.

11. The laundry washing machine of claim 9, wherein the baseline conductivity value is determined during one or more prior wash cycles, a calibration operation, an installation process, or a testing process.

12. The laundry washing machine of claim 1, wherein the fluid property value is a second fluid property value and the rinse operation is an additional rinse operation, wherein the controller is further configured to, during a wash phase of the wash cycle and prior to determining the second fluid property value, determine with the fluid property sensor a first fluid property value, and to control a preliminary rinse operation performed prior to the additional rinse operation based at least in part upon the first fluid property value.

13. The laundry washing machine of claim 12, wherein the controller is configured to determine the first fluid property value after agitating the load during the wash phase of the wash cycle.

14. The laundry washing machine of claim 1, wherein the controller is configured to determine whether to perform the rinse operation based at least in part upon the determined fluid property value.

15. The laundry washing machine of claim 1, wherein the controller is configured to accelerate spinning of the load above that at which the load is spun when determining the second fluid property value without stopping the wash basket.

16. A laundry washing machine, comprising:

a wash tub disposed within a housing;

a wash basket disposed within the wash tub and rotatable about an axis of rotation;

a drive system coupled to the wash basket to spin the wash basket about the axis of rotation;

a fluid property sensor configured to sense a fluid property that varies with an amount of detergent in fluid from the wash tub; and a controller coupled to the drive system and the fluid property sensor, the controller configured to, during a spin phase of a wash cycle for a load disposed in the wash basket, determine with the fluid property sensor a fluid property value associated with fluid released from the load and into the wash tub during the spin phase, and to selectively revert to an additional rinse phase during the wash cycle based at least in part upon the determined fluid property value;

wherein the controller is configured to control the drive system during an initial rinse phase to spin the wash basket at a rate below about RPM, to spin the wash basket during the spin phase at a first speed within a fluid release range between about RPM and about RPM to cause the fluid to be released from the load, and to determine the fluid property value while the load is being spun at the first speed and while no rinse water is being supplied to the wash tub, and wherein the controller is configured to, in response to a determination to not selectively revert to the additional rinse phase, accelerate spinning of the load above the first speed to complete the spin phase.

17. The laundry washing machine of claim 16, wherein the controller is configured to accelerate spinning of the load above the first speed to complete the spin phase without stopping the wash basket.

* * * * *